US005394795A

United States Patent [19]

Ferreol-Ragotin

[11] Patent Number: 5,394,795

[45] Date of Patent: Mar. 7, 1995

[54] ELECTRONIC POSTAGE METER HAVING TWO PRINT DRUMS FOR PRINTING BOTH FIXED AND VARIABLE DATA

[75] Inventor: André Ferreol-Ragotin, Evry, France

[73] Assignee: Neopost Industrie, Bagneux, France

[21] Appl. No.: 171,669

[22] Filed: Dec. 22, 1993

[30] Foreign Application Priority Data

Dec. 23, 1992 [FR] France ..... 92 15617

[51] Int. Cl.[6] ..... B41J 1/32

[52] U.S. Cl. ..... 101/91; 101/99; 101/110

[58] Field of Search ..... 101/52, 71, 91, 76, 101/77, 85, 93.21, 99, 110

[56] References Cited

U.S. PATENT DOCUMENTS

| | | | |
|---|---|---|---|
| 3,918,361 | 11/1975 | Malavazos et al. . | |
| 3,987,722 | 10/1976 | Goodwin | 101/91 |
| 4,519,311 | 5/1985 | Lowe | 101/91 |
| 4,580,144 | 4/1986 | Calvi | 101/93.07 |
| 4,673,303 | 6/1987 | Sansone | 101/91 |
| 5,050,495 | 9/1991 | Wu | 101/91 |
| 5,249,319 | 10/1993 | McChesney | 101/91 |

FOREIGN PATENT DOCUMENTS

| | | |
|---|---|---|
| 0172561 | 2/1986 | European Pat. Off. . |
| 0217576 | 4/1987 | European Pat. Off. . |
| 0298248 | 1/1989 | European Pat. Off. . |
| 2439677 | 5/1980 | France . |
| 2646943 | 11/1990 | France . |
| 2938026 | 3/1981 | Germany . |
| 2055699 | 3/1981 | United Kingdom . |

*Primary Examiner*—Edgar S. Burr
*Assistant Examiner*—John S. Hilten
*Attorney, Agent, or Firm*—Sughrue, Mion, Zinn, Macpeak & Seas

[57] ABSTRACT

An electronic postage meter including print apparatus for printing fixed postage data and variable postage data on a mail item advancing along a conveyor path between an inlet of the meter and an outlet thereof, the print apparatus comprising a first rotary drum, rotated by a first motor, for printing main postage data on the item, and a second rotary drum, rotated by a second motor and carrying a plurality of selectable plates, for printing auxiliary postage data on said mail item, and control means for actuating the second motor so as to print the imprint of a selected plate at a chosen position on the mail item.

7 Claims, 3 Drawing Sheets

ELECTRONIC POSTAGE METER HAVING TWO PRINT DRUMS FOR PRINTING BOTH FIXED AND VARIABLE DATA

FIELD OF THE INVENTION

The invention relates to an electronic postage meter or "franking machine" including print apparatus for printing fixed postage data and variable postage data on a mail item advancing along a conveyor path between an inlet of the meter and an outlet thereof, the print apparatus comprising first print means constituted by a first rotary drum for printing main postage data on the mail item, and second print means for printing auxiliary postage data thereon.

BACKGROUND OF THE INVENTION

Document EP 0,172,561 discloses a postage meter of that type, in which the second print means are constituted by a thermal print head controlled by a microprocessor. The thermal print head is organized so as to move substantially transversely relative to the conveyor path along which the mail items to be franked advance. As a result, the mail item must be slowed down as it goes past the print head so that the auxiliary postage data is printed correctly, and this reduces the throughput of the postage meter.

OBJECTS AND SUMMARY OF THE INVENTION

An object of the invention is to remedy that drawback of the prior art by providing print apparatus that enables the throughput of mail items to be higher than the throughput obtained with the print apparatus of the meter disclosed in the above-mentioned document.

Another object of the invention is to provide print apparatus that enables at least two different colors to be printed easily on each mail item.

Another object of the invention is to enable a specific item of data relating to the handling of the mail (mailing mode, type of mail, sequence number, etc.) to be displayed by said print apparatus.

To this end, the invention provides an electronic postage meter as defined above, wherein said second print means are constituted by a second rotary drum, one or more imprint-carrying removable plates installed in the second drum and selectively engageable by plate selection means, and control means acting on the second rotary drum and on the selection means in response to at least one item of information representing a selected plate, to a signal representing the presence of a mail item at the inlet of the conveyor path, and to an item of information representing a print position on the mail item relative to the advance direction of the mail item, so as to put the selected plate in the print position in the second rotary drum for printing the imprint of said plate by transferring ink to the chosen position on the mail item.

Compared with the print apparatus disclosed in Document EP 0,172,561, the print apparatus of the invention can accept high throughputs, i.e. higher than 5,000 mail items per hour, because the fixed and variable data is printed on a mail item without slowing the mail item down as it is advancing along the conveyor path. The control means may advantageously be programmable so that at least one print plate can be selected automatically.

BRIEF DESCRIPTION OF THE DRAWINGS

The invention is described below in more detail and with reference to the accompanying drawings, in which.

DETAILED DESCRIPTION OF THE PREFERRED EMBODIMENT

Figure 1:
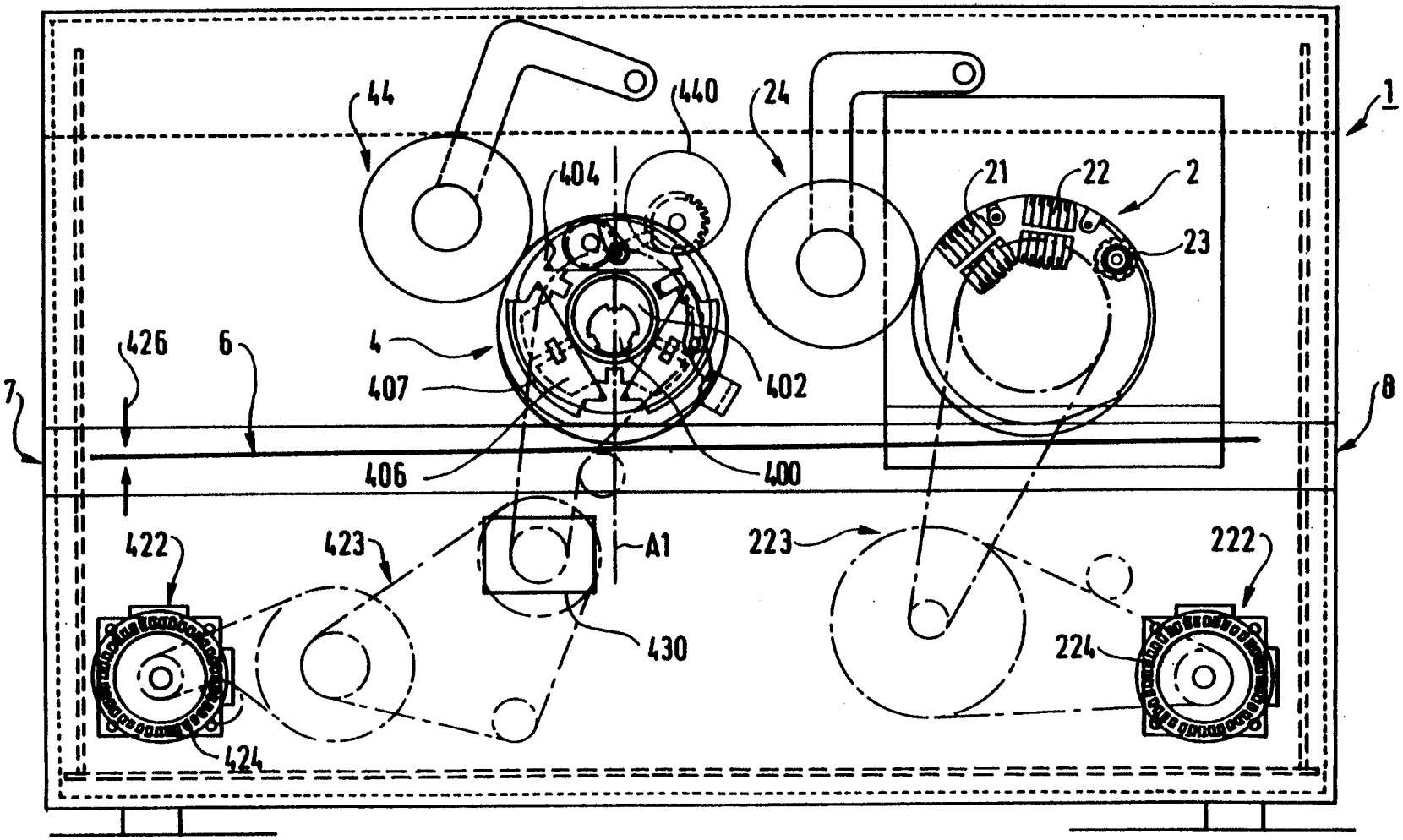
FIG. 1 is a diagrammatic elevation view of the postage meter of the invention.

In FIG. 1, the electronic postage meter or franking machine 1 includes two rotary ink-transfer print drums for printing fixed and variable data. The two rotary drums 2 and 4 have axes of rotation that are disposed transversely relative to the longitudinal axis of the conveyor path 6 for conveying the mail items to be franked, and the two rotary drums are disposed between an inlet 7 of the meter via which each mail item to be franked is inserted, and an outlet 8 of the meter via which each franked mail item is recovered. Rotary drum 4 is placed upstream from rotary drum 2 in the advance direction of the mail items, in which direction the mail items advance along the conveyor path 6. Drum 4 serves to print auxiliary postage data such as a an advertising slogan. Drum 2 serves to print main postage data such as the monetary value of the postage.

The "main" rotary drum 2 conventionally includes a postage value print wheel 21, a date print wheel 22, and a numbering device 23. Such a drum is described in Patent Application FR 90 10,064. It is associated with an inking roller 24 known per se. The main drum is rotated by an electric motor 222 via a velocity-ratio drive 223. The velocity-ratio drive 223 is conventionally constituted by pulleys and belts. The main drum 2 co-operates with a platen roller (not shown) that is known per se. The motor 222 is provided with an encoder 224 which delivers clock signals in quadrature.

The "auxiliary" rotary drum 4 is of the type described in Document EP 0,217,576. It includes a plurality of print plates 407 which are selectively engageable by an automatic plate selector, and it co-operates with an inking roller known per se.

Figure 2:
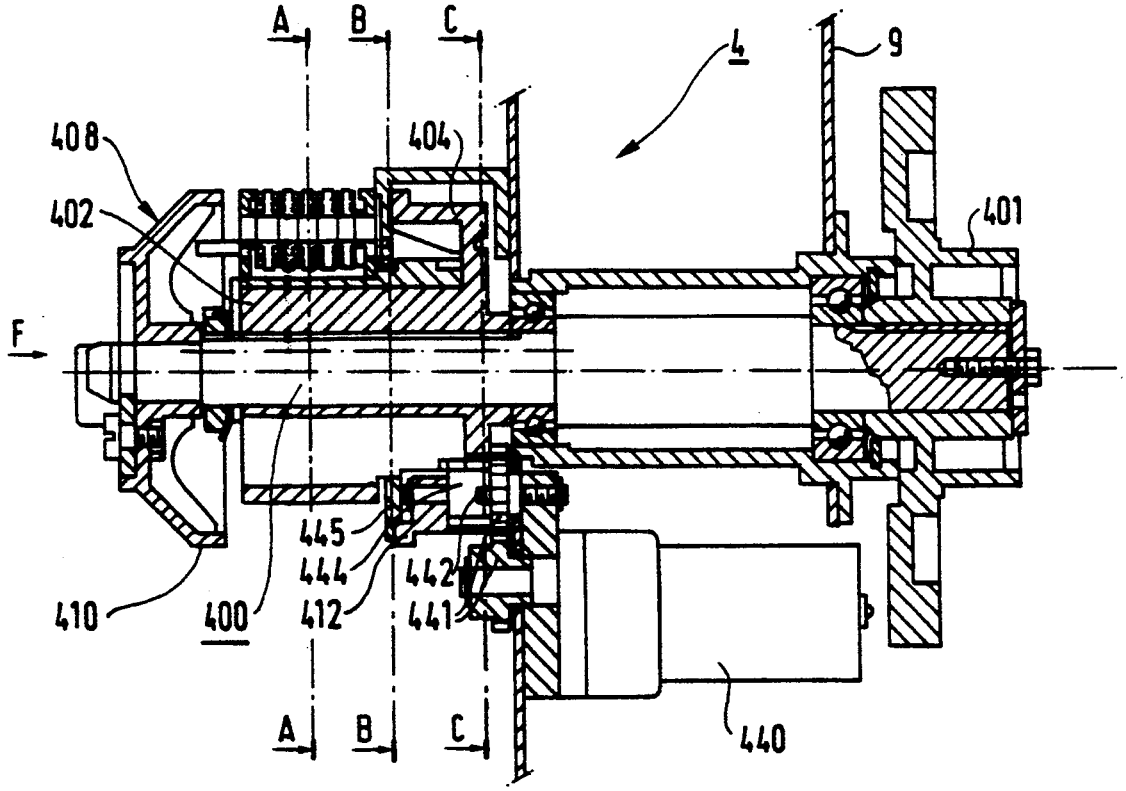
FIG. 2 is a diagrammatic view in vertical section at various levels through the second print drum.
Figure 3:
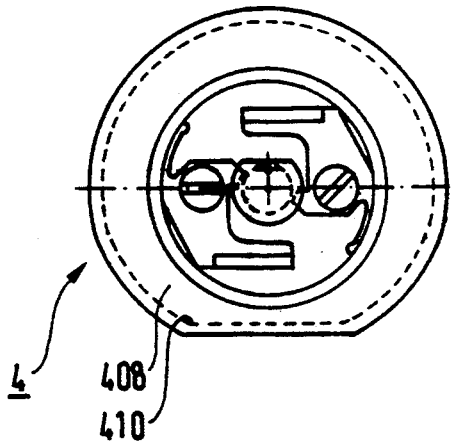
FIG. 3 is a fragmentary elevation view of the second print drum seen along arrow F of FIG. 2.
Figure 4:
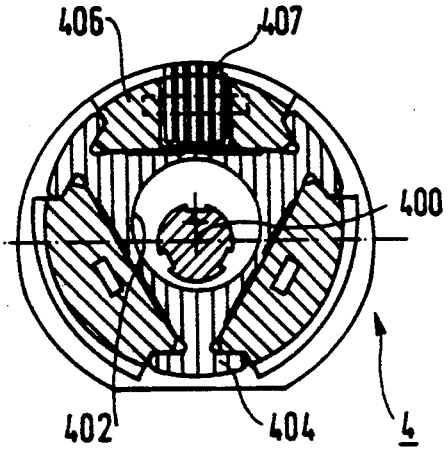
FIG. 4 is a view in section through the second print drum on A—A in FIG. 2.

In FIG. 2, the auxiliary drum 4 is fixed on a control shaft 400 carried by the base 9 of the postage meter 1. The auxiliary drum includes an eccentric ring 402 mounted on the shaft and received inside the plate support 404 which, as shown in FIG. 4, carries three removable slides 406, each of which has a specific plate 407 mounted on it. As shown in FIG. 2, one end of the shaft 400 has a coaxial cap 408 provided with a peripheral band 410 which can been seen in FIG. 3, and which co-operates with another peripheral band 412 on the eccentric ring 402 to drive the mail items with a platen roller (not shown) that is known per se.

Any type and any shape of plate may be considered, e.g. for constituting an advertising slogan, or a numbering device 407 as shown in FIG. 4, etc. Furthermore, the imprint of the auxiliary data may be disposed on a plate so that any angular position can be chosen for it relative to the longitudinal direction of the conveyor path 6.

The auxiliary drum 4 may be coupled to another electric motor 422 via a velocity-ratio drive 423 constituted by pulleys and belts, which drive engages at 401 on the end of the rotary shaft 400. The motor 422 is also mechanically coupled to the drive elements for driving the conveyor 6. A single-turn clutch 430 is mounted between the motor 422 and the auxiliary drum 4 so as to provide mechanical coupling or mechanical decoupling, thereby enabling the auxiliary drum 4 to be rotated by the motor 422. The motor 422 is provided with an encoder 424 which supplies clock signals in quadrature.

Figure 5:
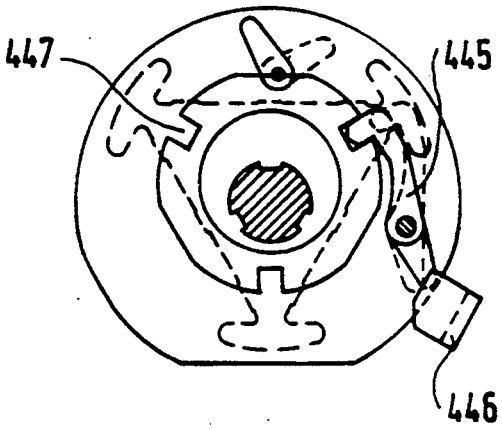
FIG. 5 is a view in section through the second print drum on B—B in FIG. 2.
Figure 6:
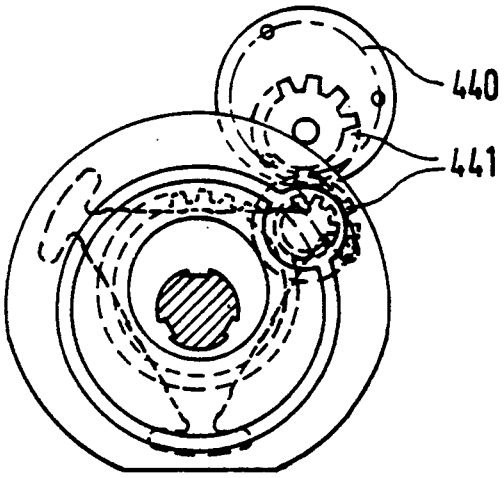
FIG. 6 is a view in section through the second print drum on C—C in FIG. 2.

The automatic plate selector includes a single-turn electric motor 440 which is shown in FIGS. 2 and 6 and which is coupled to a gear train 441 enabling the plate support 404 to be rotated in thirds of a turn about the eccentric ring 402. The function of the automatic plate selector is to respond to a selection signal by positioning a plate that has been selected to print data. The gear train 441 carries a peg 442 which is engaged in a sprocket 444. The sprocket 444 rotates the plate support 404 through a third of a turn each time the motor 440 is started. As shown in FIG. 5, a catch 445 co-operates with a cam 446 secured to the sprocket 444 to lock the rotation of the plate support 404 about the eccentric ring 402 when a selected plate is in the print position. The locking is performed by positioning the catch 445 in a notch 447 in the eccentric ring under the action of the cam 446. The slide 406 of the selected plate is identified by means of a set of sensors. In the embodiment shown in the figures, three print plates 407 are distributed around the periphery of the auxiliary drum 4, the plate referenced 407 in FIG. 4 being in the position in which it prints an imprint.

Figure 7:
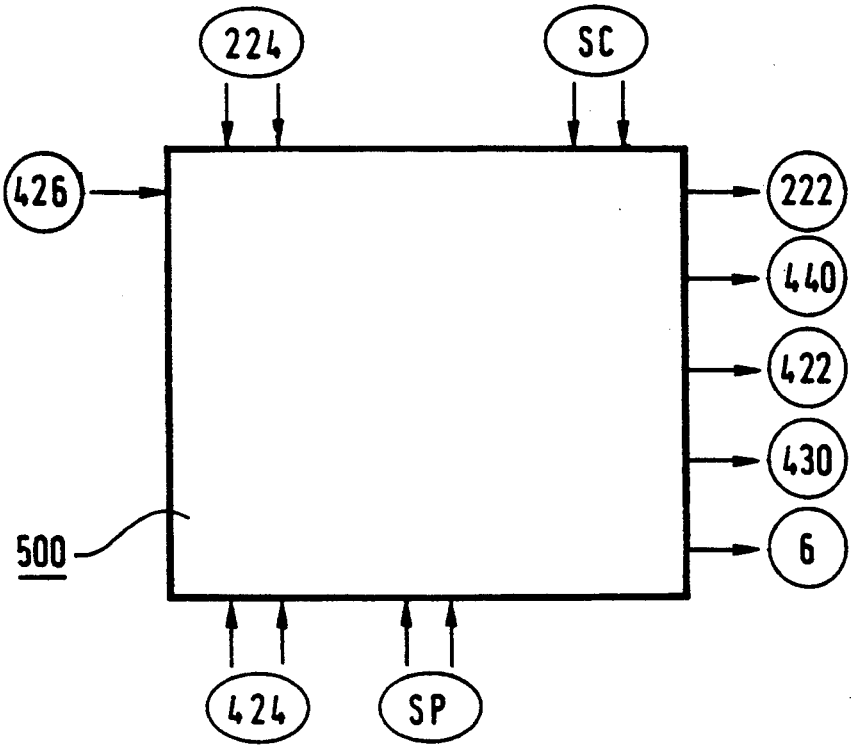
FIG. 7 is a diagram representing the control means of the print apparatus of the invention.

With reference to FIG. 7, the motors 422 & 222, and the single-turn clutch 430 are controlled by a control unit 500 having a microprocessor. The control unit may be programmed, and it supplies control signals in response to input information or signals. The control unit 500 is electrically connected to a sensor 426, e.g. a light-emitting diode, which supplies a detection signal to it indicating that the presence or the absence of a mail item to be franked has been detected at the inlet of the conveyor path 6. The input of the control unit 500 also receives the quadrature clock signals supplied by the encoders 224 and 424, an item of information SC representing a selected plate in the auxiliary drum 4, and an item of information SP representing the print position of a selected plate on the mail item(s) to be franked relative to the direction in which the mail item(s) advance(s) along the conveyor path 6. The control unit outputs a control signal for starting or stopping motor 222, a control signal for starting or stopping motor 422, a control signal for controlling the clutch 430, a plate selection signal for the single-turn motor 440, a control signal for controlling the elements of the conveyor 6 so as to start it or so as to stop it.

For the purposes of printing two different colors on each mail item handled by the postage meter, the two inking rollers 22 & 24 for inking the rotary drums 2 & 4 contain inks of different colors.

A specific plate 407 of the drum 4 is organized to as to highlight a specific item of data relating to the handling of the mail, such as the type of mail item franked, the mailing mode of the franked mail item, the sequence number of the franked mail item. This specific item of data is preferably printed in the same region as the postal imprint.

The control unit 500 operates as follows.

The items of data SC & SP are input in the control unit 500. The following parameters are recorded in the control unit 500:

N1 designates the distance between the sensor 426 and the axis A1 of the auxiliary drum 4 expressed in number of clock signals output by the encoder 424;

K designates the distance between the beginning of the selected plate and the original position of the auxiliary drum 4 expressed in number of clock signals output by the encoder 424;

L designates the distance between the leading edge of the mail item to be franked placed at the inlet of the conveyor path and the print position of the beginning of the selected plate expressed in number of clock signals output by the encoder 424; and C designates a constant representative of the non-linearity of the output of a down counter of the control unit due to the time required to accelerate the auxiliary drum 4 in rotation, e.g. 10 ms; this time is also converted into number of clock signals output by the encoder 424.

The control unit starts the motor 422 which starts the conveyor 6. In response to the presence of a mail item in the conveyor path 6 being detected by the sensor 426, the down counter of the control unit is initialized at the down count value $D=N1-K+L+C$.

At each transition of the clock signal output by the encoder 424, the value of the down counter is decremented by unity. When the value of the down counter reaches the value 0, the control unit 500 sends the control signal that actuates the clutch 430 so as to couple the auxiliary drum 4 to the motor 422. The auxiliary postage data is printed on the mail item. The control unit also receives the clock signal output by the encoder 224, and responds to it by sending the control signal that starts the motor 222 so as to rotate the main drum 2. The main postage data is then printed on the mail item.

I claim:

1. An electronic postage meter including a print apparatus for printing fixed postage data and variable postage data on a mail item advancing along a conveyor path between an inlet of the meter and an outlet thereof, the print apparatus comprising first print means comprising a first rotary drum for printing main postage data on the item, and second print means for printing auxiliary postage data thereon, said second print means comprising a second rotary drum, a plurality of imprint-carrying removable plates installed in the second drum, plate selection means for selectively engaging said plurality of imprint-carrying removable plates, and control means for controlling the second rotary drum and the selection means in response to at least one item of information representing a selected plate, to a signal representing the presence of a mail item at the inlet of the conveyor path, and to information representing a print position on the mail item relative to the advance direction of the mail item, so as to put a selected one of said plurality of plates in a print position in the second rotary drum for printing the imprint of said selected plate by transferring ink to the print position on the mail item.

2. A postage meter according to claim 1, wherein the second rotary drum includes an eccentric ring rotatably mounted about a control shaft, the eccentric ring being received inside a plate support carrying removable slides, each of which has a print plate mounted on it, and a single-turn electric motor mechanically coupled to the plate support so as to rotate it about the eccentric ring, in parts of a turn, in response to a plate selection signal supplied by the control means, until the selected plate is in the print position.

3. A postage meter according to claim 1, wherein inking rollers containing inks of different colors are associated respectively with said first and second rotary drums.

4. A postage meter according to claim 1, wherein a removable plate of the second drum is organized to print a specific item of postage data relating to the handling of the mail item, such as the type of mail item, the mailing mode of the mail item, or the sequence number of the mail item, the item of data being printed in the same region as the postal imprint on the mail item.

5. An electronic machine including a print apparatus for printing fixed data and variable data on an item advancing along a conveyor path between an inlet of the machine and an outlet thereof, the print apparatus comprising first print means comprising a first rotary drum for printing the fixed data on the item, and second print means for printing the variable data thereon, said second print means comprising a second rotary drum, a plurality of imprint-carrying removable plates installed in the second drum, plate selection means for selectively engaging said a plurality of imprint-carrying removable plates, and control means for controlling the second rotary drum and the selection means in response to at least one item of information representing a selected plate, to a signal representing the presence of an item at the inlet of the conveyor path, and to information representing a print position on the item relative to the advance direction of the item, so as to put a selected one of said plurality of plates in a print position in the second rotary drum for printing the imprint of said selected plate by transferring ink to the print position on the item.

6. A machine according to claim 5, wherein the second rotary drum includes an eccentric ring rotatably mounted about a control shaft, the eccentric ring being received inside a plate support carrying removable slides, each of which has a print plate mounted on it, and a single-turn electric motor mechanically coupled to the plate support so as to rotate it about the eccentric ring, in parts of a turn, in response to a plate selection signal supplied by the control means, until the selected plate is in the print position.

7. A machine according to claim 5, wherein inking rollers containing inks of different colors are associated respectively with said first and second rotary drums.

* * * * *